US011434635B1

(12) United States Patent
Frederick et al.

(10) Patent No.: US 11,434,635 B1
(45) Date of Patent: Sep. 6, 2022

(54) WINDOW AND CURTAIN WALL SEGMENTS, STRUCTURES, SYSTEMS AND METHODS

(71) Applicant: FreMarq Innovations, Inc., Merrill, WI (US)

(72) Inventors: Todd Frederick, Merrill, WI (US); Ben Knospe, Merrill, WI (US)

(73) Assignee: FreMarq Innovations, Inc., Merrill, WI (US)

( * ) Notice: Subject to any disclaimer, the term of this patent is extended or adjusted under 35 U.S.C. 154(b) by 0 days.

(21) Appl. No.: 17/230,168

(22) Filed: Apr. 14, 2021

(51) Int. Cl.
*E04B 2/96* (2006.01)
*E06B 3/263* (2006.01)
*E04B 2/56* (2006.01)

(52) U.S. Cl.
CPC ..... *E04B 2/96* (2013.01); *E04B 2/56* (2013.01); *E06B 3/263* (2013.01)

(58) Field of Classification Search
CPC ..... E04B 2/96; E04B 2/56; E06B 3/263
See application file for complete search history.

(56) References Cited

U.S. PATENT DOCUMENTS 3,866,374 A * 2/1975 Dallen ..... E04B 2/967 52/204.597
3,968,608 A * 7/1976 Swango ..... E04B 2/96 52/235
4,207,717 A * 6/1980 Hubbard ..... E04B 2/96 52/235
4,543,755 A * 10/1985 Crandell ..... E06B 3/5427 52/204.62
5,356,675 A * 10/1994 Unger ..... E04B 1/0046 428/33
5,381,637 A * 1/1995 Farag ..... E06B 3/5427 52/204.593
8,991,121 B1 * 3/2015 Baker ..... E04B 2/965 52/235
10,407,902 B2 * 9/2019 Doyon ..... E04B 2/885
2008/0222978 A1 * 9/2008 Salzer ..... E06B 5/116 52/202
2017/0022708 A1 * 1/2017 Dolby ..... E04B 2/90
2017/0089120 A1 * 3/2017 Moller ..... E06B 3/263
2019/0078375 A1 * 3/2019 McKenna ..... E06B 3/5409
2019/0078380 A1 * 3/2019 McKenna ..... E04B 2/967
2019/0136523 A1 * 5/2019 Claeys ..... E04B 2/965
2019/0194939 A1 * 6/2019 Frederick ..... E04B 2/967

* cited by examiner

*Primary Examiner* — Paola Agudelo
(74) *Attorney, Agent, or Firm* — Anthony J. Bourget

(57) ABSTRACT

Window wall and curtain wall mullion or transom structures, members, systems and methods including an insulating component covering substantially an entirety of an outer side of a metal structural segment where the component is connected to a metal structure of the mullion or transom via an interlocking connection, the component connected to the metal structure by clamping the component to the structure with a clamp where the clamp is secured by a fastener in a spaced relationship with respect to the component.

20 Claims, 8 Drawing Sheets

WINDOW AND CURTAIN WALL SEGMENTS, STRUCTURES, SYSTEMS AND METHODS

BACKGROUND OF THE INVENTION

There are curtain wall systems or frameworks in which glazing or other panels are fitted for buildings. Curtain walls typically comprise a grid-like framework usually made of metal profiled members arranged with transoms (i.e., structures that typically run horizontally) and mullions (i.e., structures that typically run vertically). Glazing or window panels and non-transparent panels may be secured against or within the transoms and mullions. The framing is attached to a building structure. Some panels or glazing units may be secured to adjacent mullions and transoms by use of pressure plates which are secured to the mullions and transoms. In some cases, pressure plates are secured to insulating components. Other systems do not use a pressure plate but will use structural silicone for a structurally glazed configuration and/or a captured configuration. There are also window wall systems in which glazing or other panels are fitted within or between concrete floor slabs, for instance. Examples of some window and curtain wall segments, structures or systems for which patents have been granted include those by Todd Frederick in U.S. Pat. Nos. 9,212,482, 9,663,946 and 10,450,743. While such walls, structures, segments, components, systems and methods have benefits, there is room for further improvement.

SUMMARY OF THE INVENTION

In one aspect the present invention pertains to a window or curtain wall system and separate elements such as mullions or transoms that include a thermally insulating component. In some implementations, the insulating component is a fiberglass component such as a fiberglass reinforced polymer that is connected to a metal structure by use of a clamp. The clamp is connected to the structure using a fastener such that the fastener is in spaced relation with respect to the insulating component. The metal structure may be made of steel or aluminum or other materials. The thermally insulating component enhances the insulating properties of the mullions, transoms and curtain wall system. The clamp allows the component to be firmly secured to the structural members without penetrating through the component with a fastener. Use of the clamp secured by a fastener in off-set orientation from the component avoids perforating the component which maintains component integrity and improved insulating capabilities, and further allows efficient manufacture and assembly.

In a further aspect the invention includes a mullion or transom structure having an outer side where an insulating component abuts the outer side and has a stem projecting into a space between panels of the curtain wall or window wall system, the component secured to the structure by a clamp where the clamp is secured with a fastener positioned in a spaced relationship to the component. In further aspects the insulating component does not include a stem and/or the structure utilizes structural silicone for securing panels.

In a further aspect the invention includes a mullion or transom structure where an insulating component covers the outer side of the structure and has a longitudinal stem configured to project into a space between adjacent panels and where the component is secured to the structure with a clamp where a fastener passes through the clamp in a spaced relation to the component and where the fastener is oriented perpendicular a longitudinal axis of the stem. In at least one aspect the stem is configured to structurally support a panel.

In a further system aspect the invention includes a mullion or transom structure having a clamp secured to the structure with a fastener positioned in a spaced relationship to an insulating component and first and second panels defining a space into which the stem of the component extends. The clamp secures the component to the structure.

In a further method aspect the invention includes manufacturing a structure for a curtain wall or window wall system by fastening a fastener to a clamp which secures an insulating component to the structure such that the fastener is in a spaced relation to the component. The insulating component covers an outer side of the structure. The method further includes inserting a cap to the structure to close the fastener. In aspects a stem of the component is configured to extend into a space between adjacent panels of the curtain wall or window wall system.

In a further aspect the invention includes a vertical mullion or horizontal transom structure for use with a curtain wall or window wall system including a metal mullion or transom structure, an insulating component abutting the structure and having an integral stem configured to project into a space between a first panel and a second panel of the curtain wall or window wall system, and the component secured to the structure by a clamp, the clamp secured to the structure with a fastener, the fastener positioned in a spaced relationship to the component. In aspect the component lacks a stem projecting into a space between panels, and in further aspects structural silicone is used to secure panels to the component.

In a further aspect the invention includes a mullion or transom structural member for use with a mullion or transom structure of a curtain wall or window wall system including a metal structural segment having an outer side wall having an outward-facing planar face, a transition wall extending from the side wall and projecting inward, a first fastener wall connected to the transition wall and oriented parallel the side wall, and a second fastener wall together with the first fastener wall defining a fastener slot configured to receive a fastener, the side wall in part defining a groove configured to receive a tongue of an insulating component at the outward-facing planar face.

The above partial summary of the present invention is not intended to describe each illustrated embodiment, aspect, or every implementation of the present invention. The figures and detailed description and claims that follow more particularly exemplify these and other embodiments and further aspects of the invention.

Figure 1:
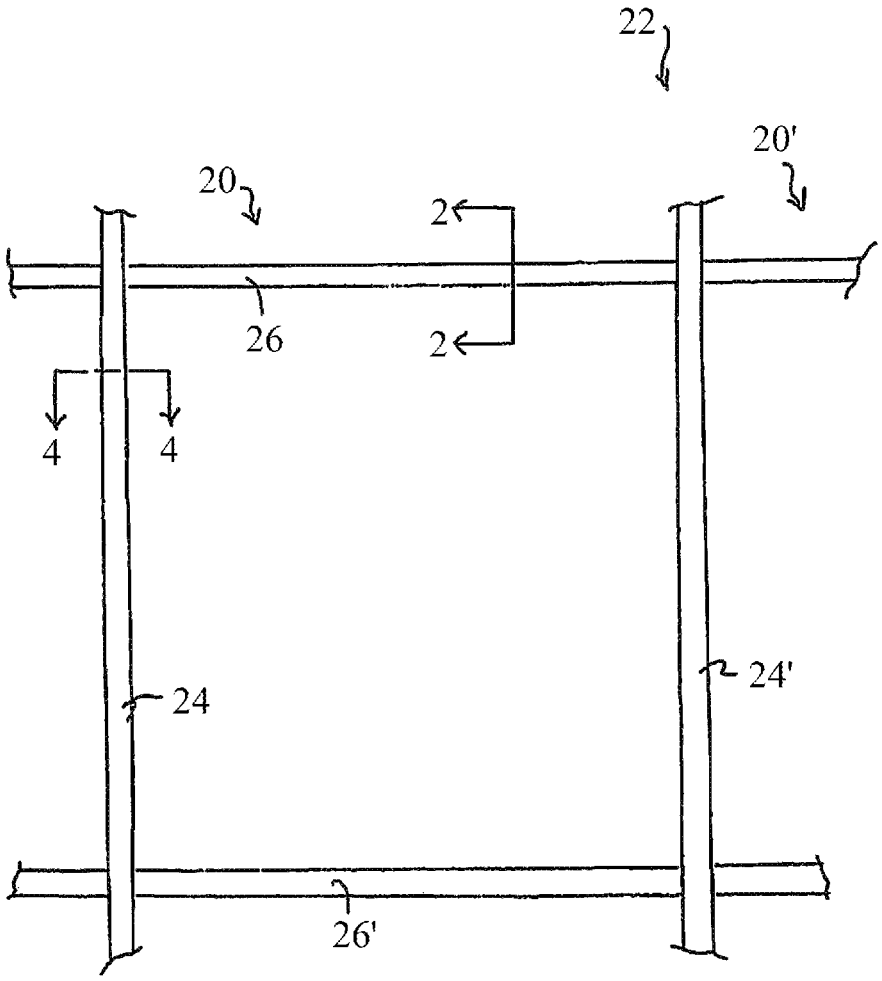
FIG. 1 is a perspective view of a curtain wall in accordance with one aspect of the invention, with panels removed for clarity.

While the invention is amenable to various modifications and alternative forms, specifics thereof have been shown by way of example in the drawings and will be described in detail. It should be understood, however, that the intention is not necessarily to limit the invention to the particular embodiments, aspects and features described. On the contrary, the intention is to cover all modifications, equivalents, and alternatives falling within the spirit and scope of the invention and as defined by the appended claims.

DETAILED DESCRIPTION OF THE INVENTION

Referring to FIGS. 1-15, aspects of the window and curtain wall components, structures, systems and methods are shown. FIG. 1 is a front view of a cell 20 of a curtain wall system 22 according to some embodiments. System 22 is shown in partial (panels removed for clarity) for installing at a building. Multiple cells 20 may comprise system 22. System 22 may also be of a window wall variety where a sill and corresponding header include anchors for securing the respective horizontal (transom) and vertical (mullion) structures to form corresponding cells.

A similar transom 26' is positioned generally parallel with transom 26. A similar mullion 24' is positioned generally parallel with mullion 24. Together mullions 24, 24' and transoms 26, 26' comprise a single cell 20 of curtain wall system 22. Mullions 24 and transoms 26 also comprise additional cells 20' or components of cells 20' of system 22. Panels such as windows, glass, or plates or other objects may be inserted within a cell 20 to cover or span the space, light or opening created by mullions 24 and transoms 26.

Figure 2:
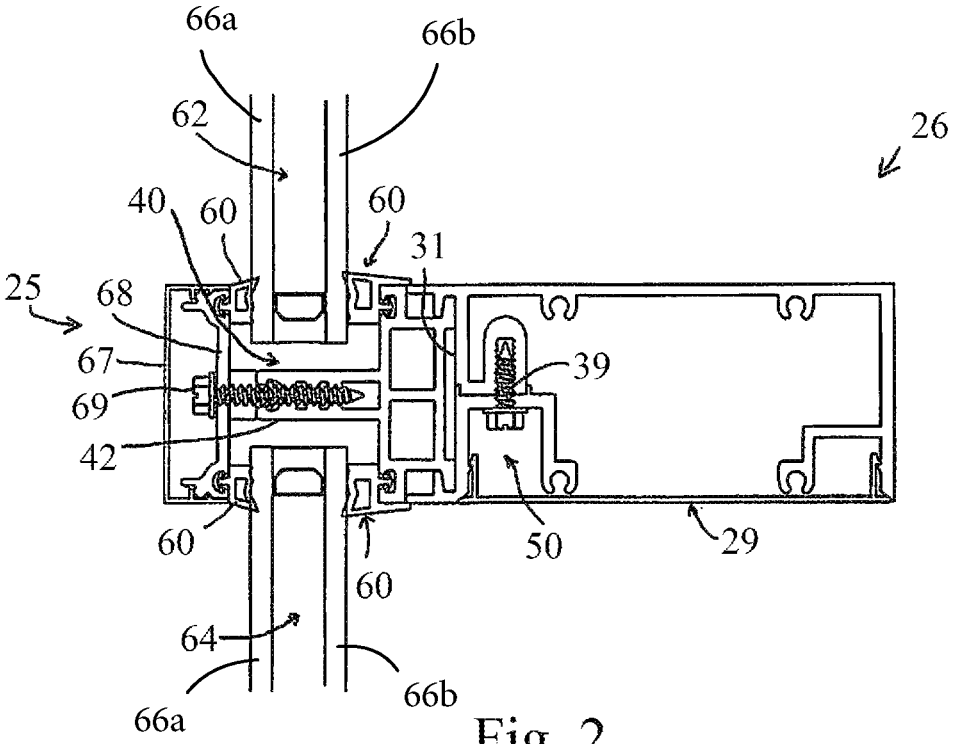
FIG. 2 is section view of a horizontal transom taken along line 2-2 of FIG. 1.
Figure 3:
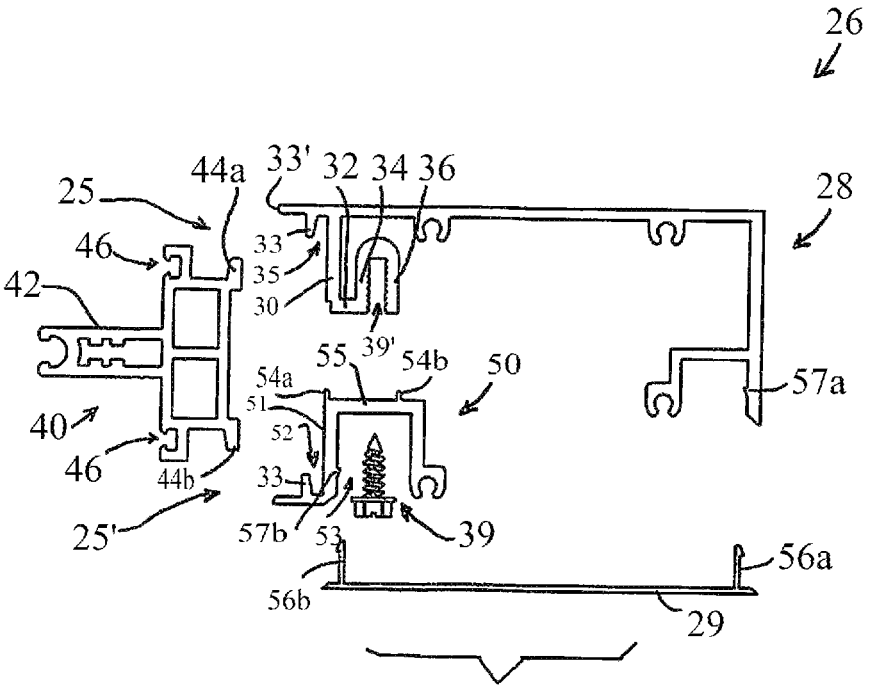
FIG. 3 is an exploded view of the horizontal transom of FIG. 2 with portions removed for clarity.
Figure 4:
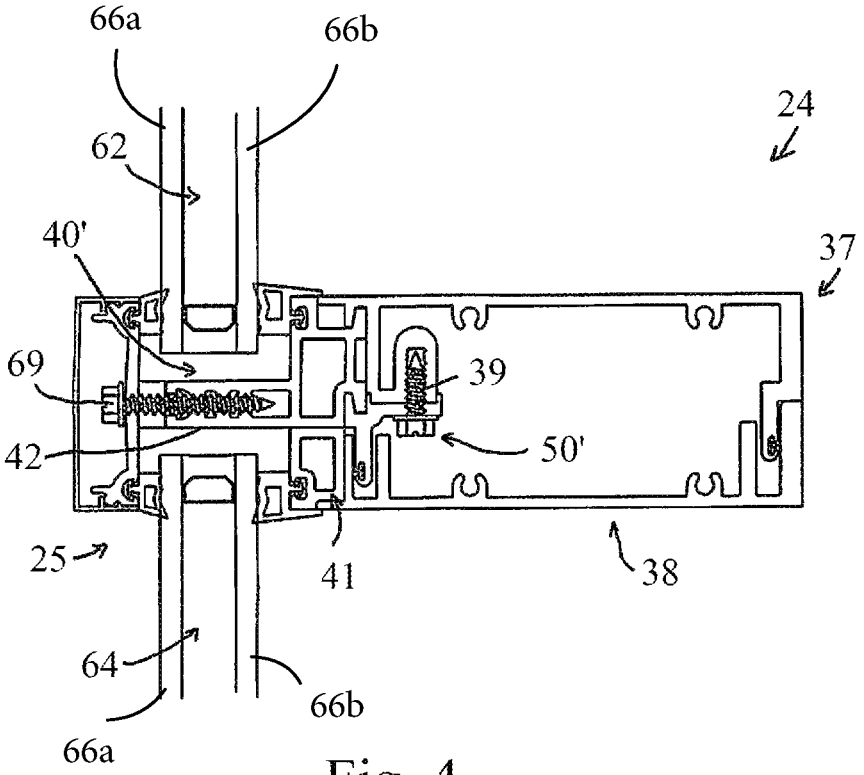
FIG. 4 is a section view of a vertical mullion taken along line 4-4 of FIG. 1.
Figure 5:
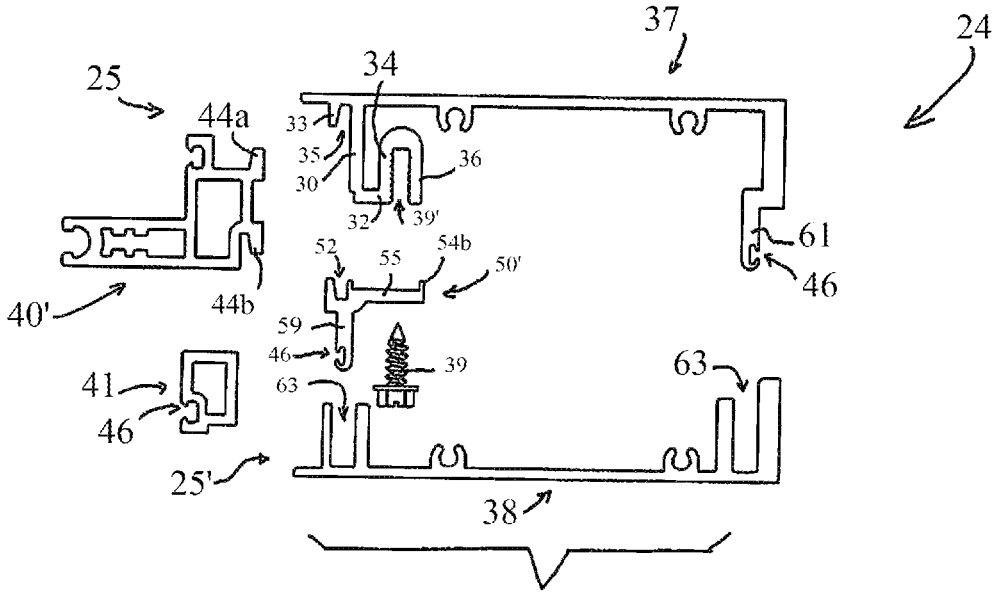
FIG. 5 is an exploded view of FIG. 4 with portions removed for clarity.

FIG. 2 is a sectional view of a transom structure 26 of cell 20. FIG. 3 is an exploded view of transom 26 with portions removed for clarity. FIG. 4 is a sectional view of a mullion structure 24 of cell 20. FIG. 5 is an exploded view of mullion 24 with portions removed for clarity.

As shown in FIG. 2 and FIG. 3, transom 26 has an outer side generally designated by reference number 25. The outer side 25 of transom 26 is positioned toward an exterior of a building to which building the transom 26 is connected. An insulating component 40 is positioned to cover the outer side 25 of transom 26. The transom 26 is an example of a dry glaze structure in that transom 26 does not utilize structural silicone for securing panels, instead using a pressure plate 68.

Component 40 includes a stem 42 which projects into a space defined by a first panel 62 and a second panel 64. First panel 62 includes parallel planer subpanels 66*a*, 66*b*. Component 40 is secured to transom 26 by a clamp 50. Clamp 50 is secured to transom segment 28 with a fastener 39. The fastener 39 is positioned in a spaced relationship with respect to component 40. Positioning the fastener 39 in a spaced relationship allows for component 40 to be held or clamped to transom 26 without having to insert a fastener into component 40. Positioning the fastener 39 as addressed herein is also convenient for manufacture and assembly of transom 26, which may occur in the field or onsite at a building construction, i.e., component 40 may be applied to transom 26 in a manufacturing facility or conveniently at the location of the building construction. In one aspect the fastener 39 is secured by inserting a fastener 39 such as a metal screw or other fastener generally perpendicularly to the outer side 25 and/or perpendicularly and/or generally perpendicularly to the elongated stem 42 of component 40. Such perpendicular fastening eases securing of the clamp 50 and component 40 because interference with the stem 42 and component is avoided. A screwdriver has sufficient clearance to drive fastener into position. Having component 40 cover the entirety of the outer side 25 of the transom 26 provides for improved insulating characteristics because the metal portions of transom 26 are covered and/or not exposed to the outside environment. Such insulation reduces or inhibits thermal transfers. Securing fastener 39 through clamp wall 55 avoids contact with component 40. The integrity of component 40 is maintained in that there are no penetrations through component 40 or cracks or breaks of the component 40 so that it may maintain insulating coverage of the clamp 50 and segment 28 and cap 29.

In aspects transom 26 is made of metal, such as steel. Other metals and materials may also be used to make transom 26. Component 40 is an insulator. In one aspect component 40 is a polymer component. In one aspect component 40 is made of fiberglass reinforced polymer or glass-fiber reinforced polymer. A variety of types of plastic, glass, fiberglass and/or other materials may be used to make component 40. Different materials may be used for component 40, including different material blends.

Transom 26 includes clamp 50 which secures or clamps component 40 to and along a length of outer side 25 of transom segment 28. Clamp 50 in one aspect is made of metal such as steel. Other metals and materials are also contemplated for manufacture of clamp 50. Clamp 50 has a length which spans the length or substantially the length of segment 28. A fastener 39 secures clamp 50 to segment 28. In one aspect, fastener 39 inserts through clamp 50 and into a fastener slot 39' of segment 28. Multiple fasteners 39 are used to connect clamp 50 and component 40 along a length of segment 28. In one aspect fastener slot 39' is defined by a first fastener wall 34 and a second fastener wall 36 of segment 28. In one aspect first fastener wall 34 extends from a transition wall 32, which transition wall 32 extends from side wall 30 and projects inward from side wall 30. In one aspect first fastener wall 34 is oriented parallel with side wall 30. Second fastener wall 36 in one aspect is connected to first fastener wall 34 by a bridge wall which in one aspect also defines fastener slot 39'. Fastener slot 39' is configured with a width to accommodate receipt of a shank of fastener 39 where the shank has a longitudinal axis oriented perpendicular stem 42 of component 40 (or parallel outward-facing planar face 31).

Component 40 includes tongues 44*a*, 44*b* which insert into and mate with corresponding groove 35 of segment 28 and groove 52 of clamp 50. In one aspect a first tongue 44*a* mates with a corresponding first interlock groove 35 of structure 26 and second tongue 44*b* mates with a corresponding second interlock groove 52 of clamp 50. In one aspect the first groove 35 and second groove 52 have an identical, but reverse or mirror-image configuration. In one aspect first tongue 44*a* and second tongue 44*b* have identical reverse configuration, i.e., a reverse and/or mirror-image configuration. Component 40 also includes a pair of seal receiver slots 46 configured to receive seals 60 which abut respective panels 62, 64.

In one aspect component 40 abuts outer side wall 30 to cover outward-facing planar face 31 of transom 26. Component 40 also covers the remaining outward-facing aspects of transom 26, such as a terminal end of tab 33' of segment 28 and tab 33. In one aspect component 40 abuts terminal end 33' and wall 30. Component 40 also covers clamp 50.

For assembly, component 40 is positioned with tongue 44*a* inserted into groove 35 while also abutting wall 30. Component 40 is positioned along the length, or substantially along the length of segment 28. Clamp 50 is positioned against segment 28 while arranging groove 52 to receive tongue 44*b*. When the tongues 44*a*, 44*b* are set within grooves 35, 52, fastener 39 (or multiple fasteners 39) is introduced through clamp 50 and into fastener slot 39' to secure clamp 50 and component 40 to segment 28 to create transom 26. Clamp 50 in one aspect is generally "U" shaped having opposing walls which define a gap 53. Fastener 39 is inserted into gap 53 and secured through clamp wall 55 and into fastener slot 39'. Gap 53 provides clearance for a tool or portion of a tool such as a screwdriver or nut driver to power-drive fastener 39 through clamp wall 55 into position. Configuring gap 53 and orienting fastener slot 39' perpendicular to stem 42 allows for convenient installation clearance of clamp 50 while stem 42 extends outwardly from side wall 30. Fasteners 39 may be conveniently installed perpendicularly to the extending stem 42 and without penetration of component 40. Due to the arrangement, component 40 does not inhibit access for a tool used to install fasteners 39. Once multiple fasteners 39 have been inserted along the length of clamp 50 and segment 28 to secure component 40 along the length of transom 26, a cap 29 is connected to segment 28 and clamp 50. In one aspect, cap 29 includes a first finger 56*a* (having an outer hook) which inserts inward to segment 28 to friction-fit and/or catch upon an inner rim 57*a* of segment 28, while a second finger 56*b* having an outer hook inserts inward to gap 53 of clamp 50 to friction-fit and/or catch upon an inner rim 57*b* of clamp 50 to secure cap 29 to transom 26. Once cap 29 is secured to transom 26, access to fasteners 39 is closed, and access to fasteners 39 is prohibited. Cap 29 also spans the length or substantially the length of segment 28, and together with component 40, fasteners 39, and cap 50, form a fully completed transom 26. Transom 26 is ready to secure to a building and receive panels 62, 64 which are secured against seals 60 positioned within seal receiver slots 46 of component 40. In some aspects a fully completed transom 26 also includes inserted panels. A spacer block 65 may be placed upon stem 42 to structurally support a terminal end of and the weight of panel 62. In one aspect pressure plate 68 is secured to stem 42 with pressure plate fastener 69 which tightening causes seals 60 to press against respective panels 62, 64 and hold panels 62, 64 firmly against seals 60 positioned within seal receiver slots 46. A plurality of pressure plate fasteners 69 are inserted along transom 26 to secure pressure plate 68 and panels 62, 64 into position. In one aspect fastener 69 screws into a pre-set fastener slot defined by stem 42. The slot is preset to avoid damage or cracking of component 40 when the fastener is inserted, and sized to firmly accept fastener 69 to apply pressure to pressure plate 68 when the fastener is tightened. A fastener 69 may self-thread within the fastener slot. An outer cap 67 is connected to and positioned outward of pressure plate 68. In one aspect pressure plate 68 is made of fiberglass, for instance, to provide a desired thermal conductivity. Pressure plate 68 may also be made of other material, including metal. As shown in FIGS. 2 and 3, when component 40 is secured to segment 28 and clamp 50, the interlocked tongues 44 within grooves 35, 52 allow component 40 to be structurally secured into position to support panel 62. Component 40 is devoid of passages that lead from the exterior environment to the metal portions of transom 26, thereby insulating transom 26 from exterior thermals.

In further reference to FIG. 3, clamp 50 includes a pair of nodes 54*a*, 54*b* positioned at clamp wall 55. Nodes 54 are spaced to form a gap to receive transition wall 32 (and second fastener wall 36) of segment 28 for convenient and secure alignment of clamp 50 to segment 28. Node 54*a* insets into a corresponding notch formed in outer side wall 30 or transition wall 32 as shown in FIG. 2. In one aspect nodes 54 span the length of clamp 50 and promote setting of clamp 50 into position along fastener wall 36 for exact alignment. In one aspect, planar face 51 of clamp 50 aligns along a common plane with outward-facing planar face 31 of side wall 30.

FIG. 4 is a cross section in accordance with a mullion aspect of the invention. FIG. 5 is an exploded view of FIG. 4 with portions removed for clarity of description. Mullion 24 includes a first metal segment 37 connected to a second metal segment 38. Segment 37 defines outer side 25 to which is connected component 40'. Second segment 38 defines outer side 25' to which is connected component 41. Components 40', 41 cover an entirety of the outer side 25, 25' of mullion 24. Second segment 38 includes a groove 63 which receives a wing 61 of first segment 37 and a groove 63 which receives a wing 59 of clamp 50'. Clamp 50' is a generally "L" shaped clamp. Second segment 38 includes a second component 41. In one aspect component 41 is bonded to segment 38 with an adhesive. In one aspect component 41 is bonded to segment 38 with a strip of adhesive and with treatments to rigidly secure component 41. Component 41 includes a seal receiver slot 46 which receives a seal 60. Component 40' includes stem 42 which extends between respective panels 62, 64. Component 40' includes tongues 44*a*, 44*b* which insert within groove 35 of segment 37 and groove 52 of clamp 50'. Clamp 50' is positioned against segment 37 and secured by a fastener 39 to secure or clamp component 40' against segment 37 and mullion 26. In one aspect segment 37 includes transition wall 32 against which clamp wall 55 of clamp 50' abuts. In one aspect a fastener slot 39' is configured at segment 37 similar to fastener slot 39' of transom 26. In one aspect a second fastener wall 36 is provided which in part defines slot 39' for receiving fastener 39. Fastener 39 is inserted through clamp wall 55 and into slot 39' to secure clamp to segment 37 while also securing or locking component 40' against segment 37 and mullion 24. Configuration of clamp 50' allows for fastener 39 to be positioned parallel or generally parallel to side wall 30, and accommodates ease of manufacture of a mullion 24 having thermal break with structural strength.

In manufacture, component 40' is positioned against segment 37 with tongue 44*a* inserted into groove 35. Clamp 50' is positioned against segment 37 such that tongue 44*b* inserts into groove 52. A fastener 39 inserts into clamp 50' to secure component 40' into a locked position, and such that stem 42 extends between panels 62, 64. After a plurality of fasteners 39 are used to secure a length of clamp 50' and component 40' along segment 37, segment 38 is inserted upon segment 37 and clamp 50' so that wing 59 and wing 61 are received into grooves 63, 63 of segment 38. Due to tight tolerances and frictional forces, segment 38 is locked upon segment 37 to provide structural integrity. Access to fasteners 39 is closed. Second component 41 aligns and in some aspects abuts component 40' which together insulate the metal aspects of segments 37, 38 from external thermal exposure. Components 40' and 41 include polymer and fiberglass materials as noted herein. As with the transom 26 noted herein, pressure plates 68, pressure fasteners 68 and outer caps 67 are used to finish securing panels 62, 64 to mullion 24. Similarly, seal receivers 64 and seals 60 are used to isolate panels from components 40', 41 and pressure plates 68. Clamp 50' also includes a node 54 or nodes 54*a*, 54*b* for alignment with fastener wall 36. A notch may be formed in wall 30 in one aspect to receive a node 54*b* of clamp 50' to assist with alignment.

Figure 6:
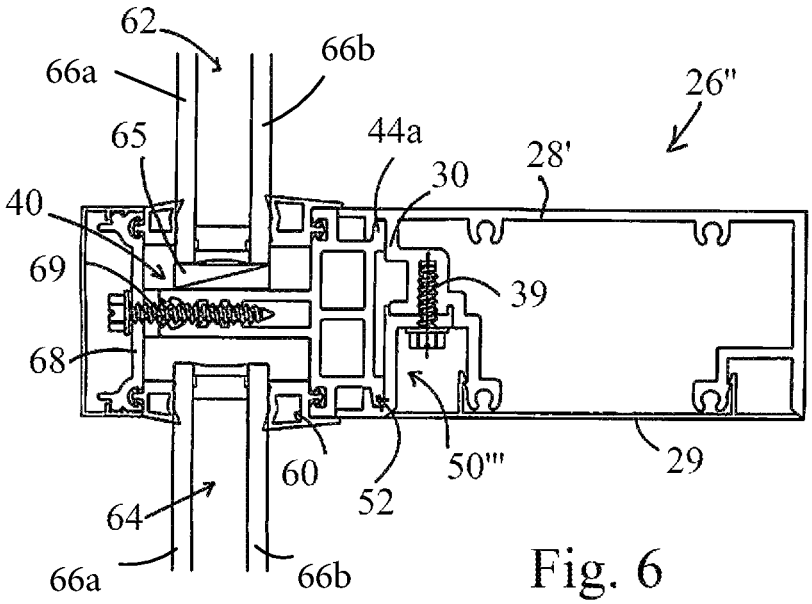
FIG. 6 is a section view of a horizontal transom in accordance with a further aspect of the invention.

FIG. 6 is a cross section of a further aspect of a transom 26" in accordance with the invention. Transom segment 28' has a side wall 30 which extends downward to a cap 29. Clamp 50'" secures to segment 28' with a fastener 39 and such that component 40 is secured to transom 26" with a clamping force. Tongues 44*a*, 44*b* insert within groove 35 of segment 28' and within groove 52 of clamp 50'". Stem 42 of component 40 extends between panels 62, 64. Panel 62 is supported upon a spacer block 65 which is positioned upon stem 42. It may be appreciated that different configurations of segments and clamps may be utilized without departing from the spirit of the invention. Having a fastener 39 oriented perpendicularly to side wall 30 accommodates ease and efficiency of installation while also avoiding having to penetrate through a layer of component 40 to maintain thermal integrity of component 40 and transom 26 or mullion 24.

Figure 7:
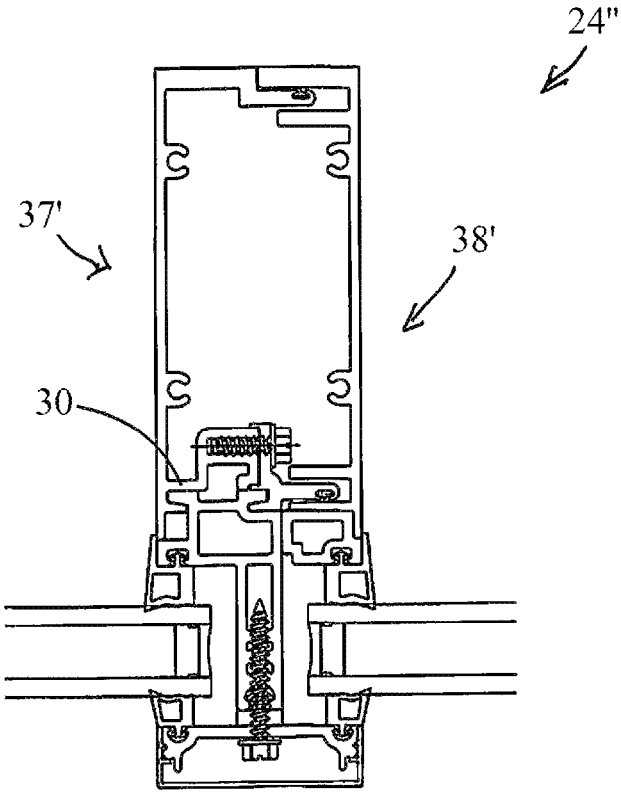
FIG. 7 is a section view of a vertical mullion in accordance with a further aspect of the invention.

FIG. 7 is a cross section of a further aspect of a mullion 24" in accordance with the invention. It may be appreciated that a variety of configurations for outer side wall 30 may be utilized without departing from the spirit of the invention.

Figure 8:
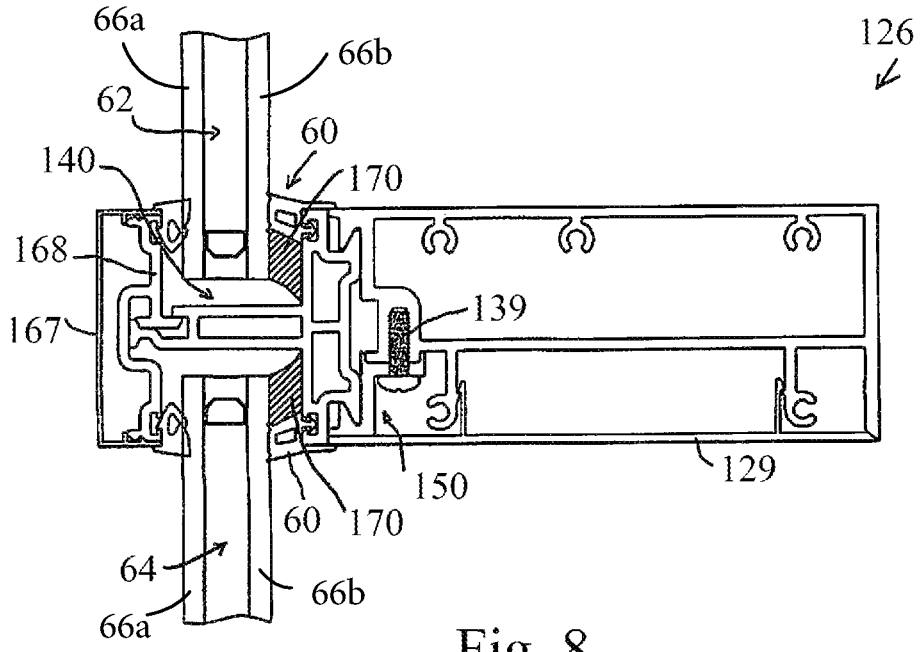
FIG. 8 is a section view of a horizontal transom in accordance with a further aspect of the invention.
Figure 9:
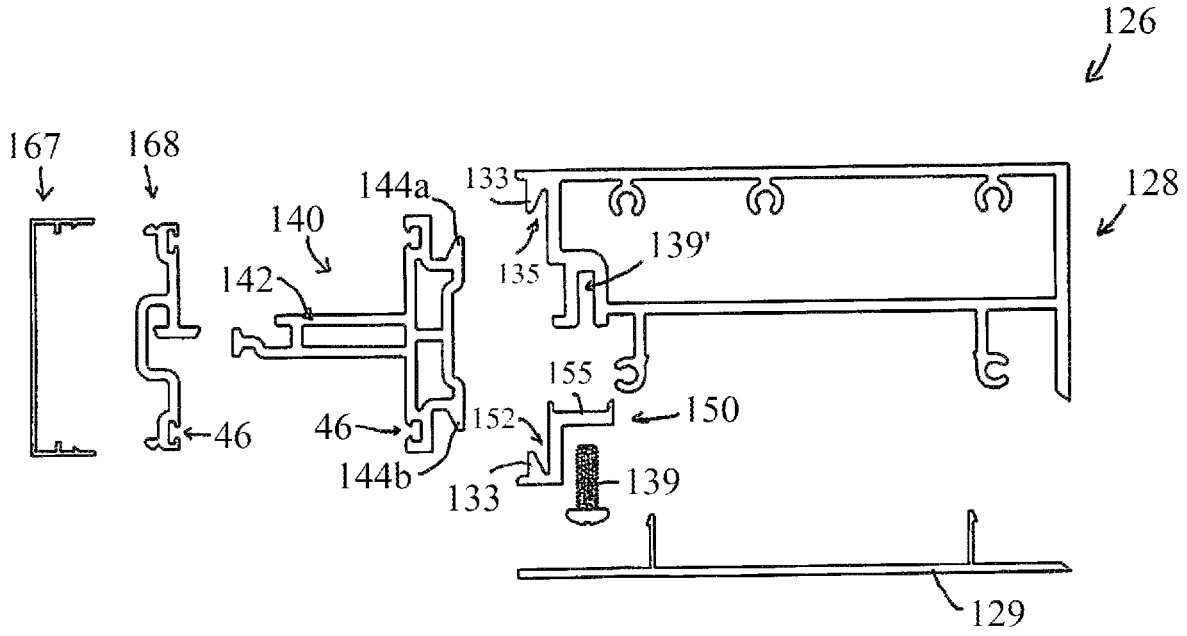
FIG. 9 is an exploded view of FIG. 8 with portions removed for clarity.
Figure 10:
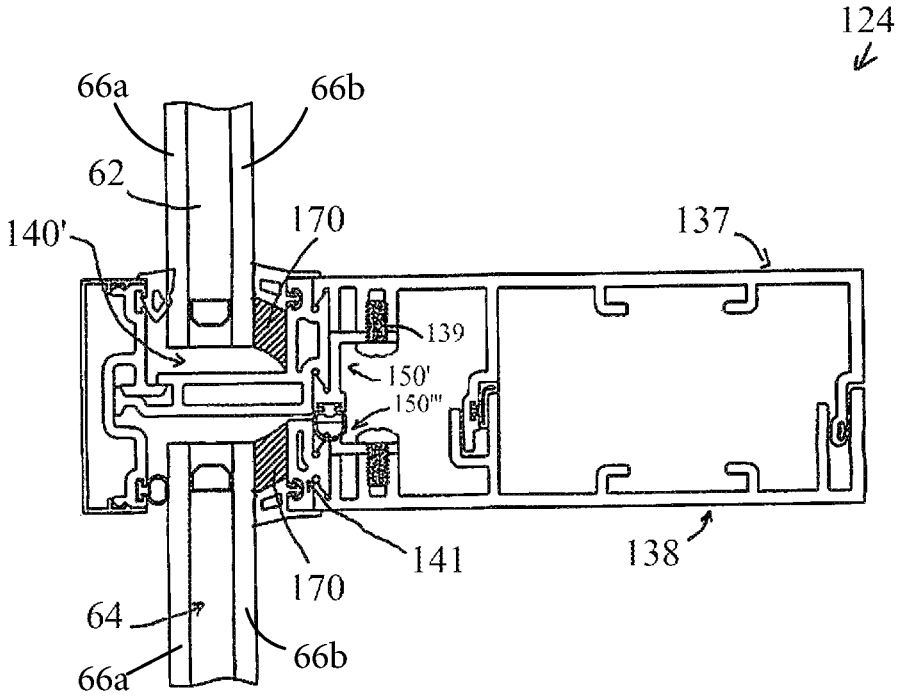
FIG. 10 is a section view of a vertical mullion in accordance with a further aspect of the invention.
Figure 11:
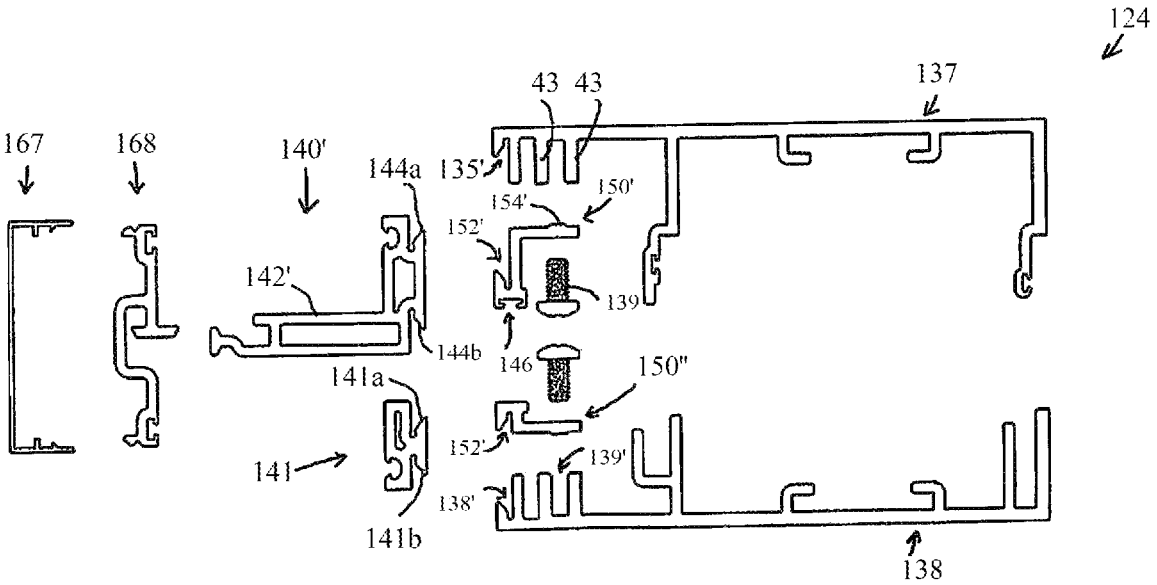
FIG. 11 is an exploded view of FIG. 10 with portions removed for clarity.
Figure 12:
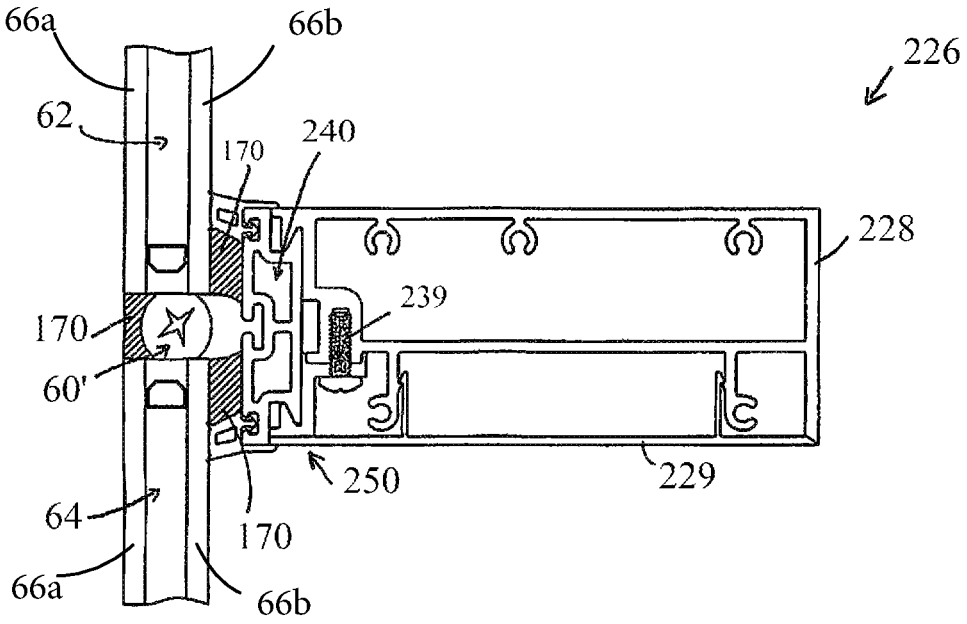
FIG. 12 is a section view of a horizontal transom in accordance with a further aspect of the invention.

FIG. 8 is a section view of a horizontal transom in accordance with a further aspect of the invention. FIG. 9 is an exploded view of the transom of FIG. 8 with portions removed for clarity. FIG. 10 is a section view of a vertical mullion in accordance with a further aspect and FIG. 11 is an exploded view of the mullion of FIG. 10. These views represent one aspect of a "Captured" type of structure which employ structural silicone 170 to secure panels 62, 64 to the mullion 124 and transom 126 structures, and utilize a stem 142 of component 140 extending between panels together with an external plate 168 and cap 167. Component 140 is clamped onto transom segment 128 using clamp 150, with fastener 139 secured through clamp wall 55 into fastener slot 139' while tongues 144*a*, 144*b* mate with groove 135 of segment 28 and groove 152 of clamp 150. Component 140 includes a stem 142 which extends into a gap between panels 62, 64. Component 140 is an insulating component and covers exterior end/side 25 of segment 128, clamp 150 and cap 129. Structural silicone 170 is used to secure panels 62, 64 to component 140. In one aspect silicone 170 includes a mix of curing, structural material which is applied in a "wet" manner and cures to structurally bond the panels to the component 140. In aspects, seals 60 are also inserted into seal receiver slots 46 and abut the silicone 170. Plate 168 connects to component 140 and captures additional seals 60 in a friction-fit arrangement. Outer cap 167 connects to plate 168. Plate 168 and cap 167 may also be insulating and made of polymer or polymer blend materials. Cap 167 may also be cosmetic and made of other materials. Structural cap 129 inserts into transom segment 128 which prevents access to fastener 139 and completes structural closing of transom 126.

FIG. 10 and FIG. 11 show vertical mullion 124 utilizing two clamps 150', 150". Each clamp clamps or secures a respective component 140', 141 to respective mullion segments 137, 138. Components 140', 141 include tongues 144*a*, 144*b*, 141*a*, 141*b* which mate with respective grooves of mullion segments 137, 138 and clamps 150', 150" (See FIG. 11). In this aspect component 141 is clamped into position without use of an alternative or additional adhesive. The respective components 140', 141 are secured to respective mullion segments 137, 138 which segments are then connected together as shown in FIG. 10. Structural Silicone or other structural adhesive 170 is used to secure panels 62, 64 to components 140', 141, together with seals 60. Clamp 150, 150" may include a note 154 for precise alignment with respective ribs 43 of mullion segments 137 138. Ribs or walls 43 define fastener slots 139', 139' for receiving fasteners 139 to secure clamps 150', 150" into position without contacting components 140', 141. Clamp 150' includes a seal receiver slot 146, while components 140', 141 cover or substantially cover respective mullion segments and clamps. Stem 142' extends between panels 62 and receives a plate 168 to friction-fit seals 60 at an exterior of panels 62, 64. Plate 168 in one aspect is also made of thermally insulating material, including a polymer. Mullion 124 is also a captured style of structure using structural adhesive 170 to secure panels 62, 64.

Figure 13:
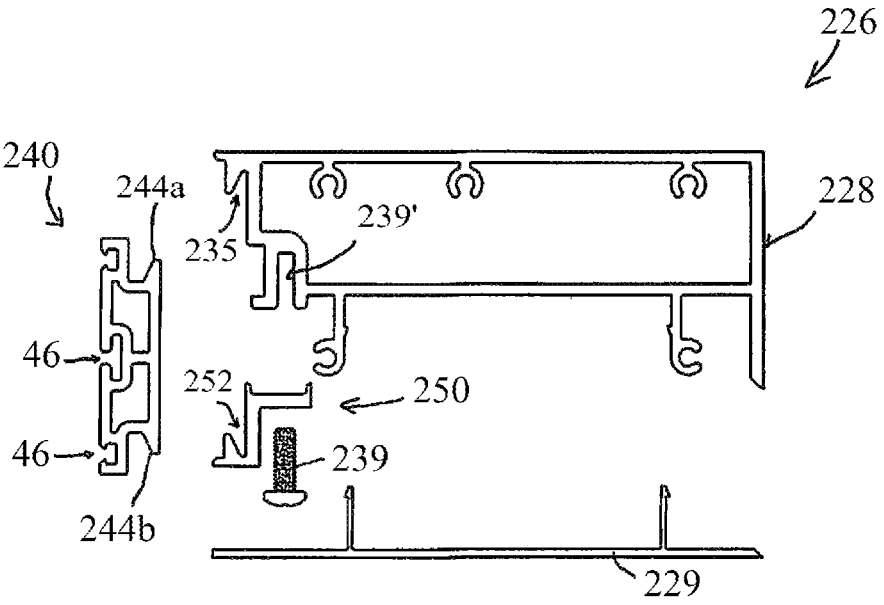
FIG. 13 is an exploded view of FIG. 12 with portions removed for clarity.

FIGS. 12-15 present alternative aspects depicting a Structurally Glazed (SSG) system where panels 62, 64 are secured using structural adhesive 170 and without an external plate or cap. FIG. 13 shows clamp 125 having groove 252 which receives a corresponding tongue 244*b* of insulating component 240, and transom segment 228 having groove 235 which receives a corresponding tongue 244*a* of component 240. Fastener 239 inserts through clamp 250 into fastener slot 239 to secure clamp 250 and component 240 to transom 226. An entire outer side of transom 226 is covered by insulating component 240. Panels 62, 64 are secured to component 240 using structural adhesive 170, such as structural silicone. Component 240 incudes seal receiver slots 46 for receiving a variety of seals 60. This structurally glazed configuration presents a clean or smooth exterior surface without a plate or cap. A seal 60' is positioned between panels 62, 64. In one aspect seal 60' includes material which is the same or similar to that of components 40, 140, 240.

Figure 14:
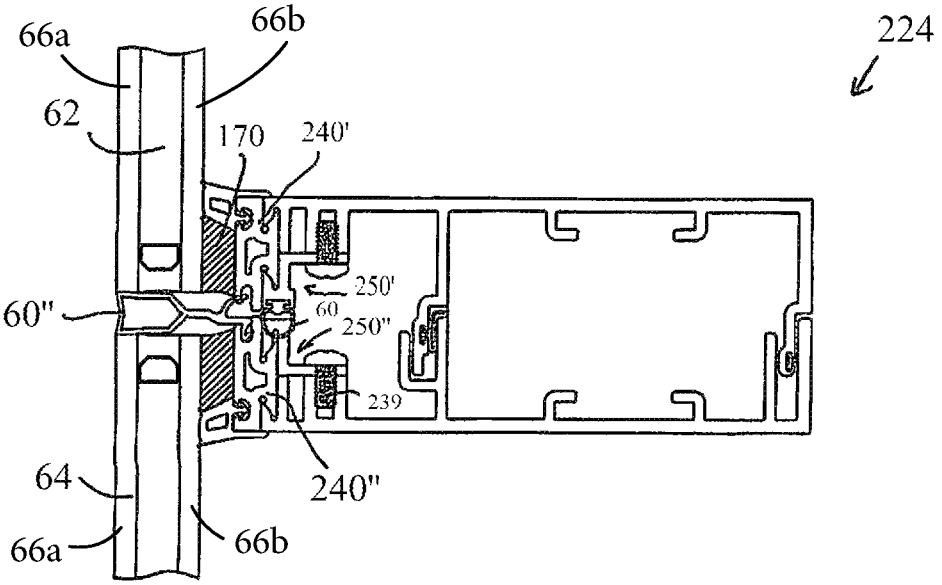
FIG. 14 is a section view of a vertical mullion in accordance with a further aspect of the invention.
Figure 15:
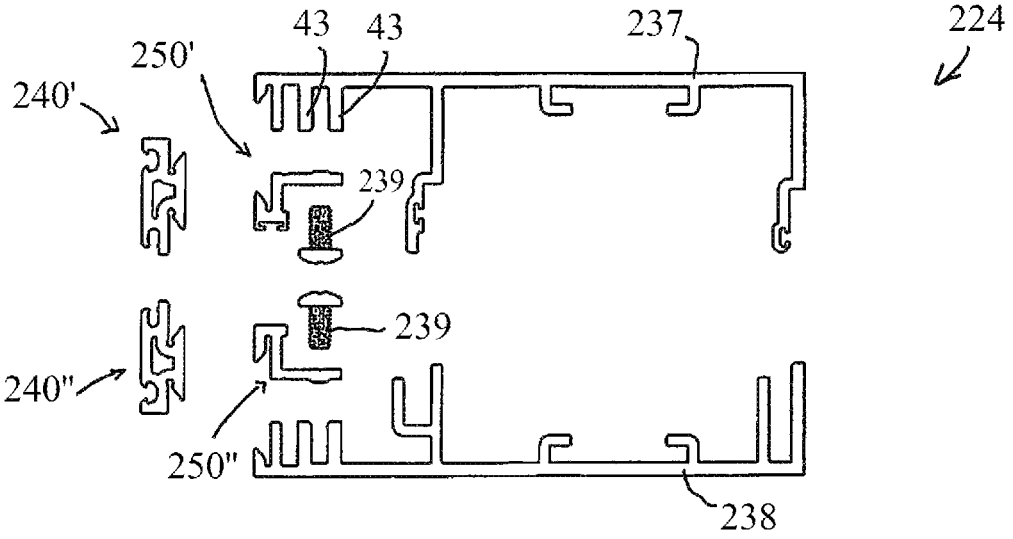
FIG. 15 is an exploded view of FIG. 14 with portions removed for clarity.

FIGS. 14 and 15 present mullion 224 aspects and show use of two clamps 250', 250" which secure respective components 240', 240" to mullion segments 237, 238. Respective fasteners 239 insert into respective clamps 250 and utilize tongue and groove arrangements with components 240 for clamping. Fasteners 239 are oriented in a spaced relation with components 240 to preserve the integrity of the components 240. A seal 60 is included into one of the clamps 250' so that the combined components 240', 240" and seal 60 cover the entirety of exterior side of segments 237, 238. A structural adhesive 170, such as structurally cured silicone is used to connect panels 62, 64 to components 240', 240". A seal 60" is positioned between panels 62, 64 and inserts into seal receiver slots 46 of respective components.

In one method aspect, a bottom portion of panel 62 is connected to segment 237 and a top portion of pane 62 is connected to a segment such as segment 238. A separate panel 64 may likewise be connected to respective top and bottom segments of segment 237 and 238. Thereafter the separate panels 62, 64 may be combined (brought together) by inserting the segment 237 associated with panel 62 into the segment 238 associated with panel 64. In one aspect, the invention includes a panel system where a panel 62 includes a lower portion connected to segment 237 and an upper portion connected to segment 238 utilizing the respective clamps 250', 250" for a modular system for assembly. Similar modular configuration and assembly may also be used for the other structures noted herein.

It should be understood, of course, that the foregoing relates to exemplary embodiments of the invention and that modifications may be made without departing from the spirit and scope of the invention as set forth in the following claims.

We claim:

1. A vertical mullion or horizontal transom structure for use with a curtain wall or window wall system, the mullion or transom structure comprising:

a metal mullion or transom structure having an outer wall;

an insulating component abutting the outer wall and having a seal receiver configured to receive a seal to abut against a panel, the component covering an entirety of the outer wall; and the component secured to the structure by a clamp, the clamp secured to the structure with a fastener, the fastener positioned in a spaced relationship to the component.

2. The mullion or transom structure of claim 1 where the component is a fiberglass reinforced polymer.

3. The mullion or transom structure of claim 1 where the clamp is a metal clamp having an interlock groove which mates with a corresponding interlock tongue of the component.

4. The mullion or transom structure of claim 1 where the component includes a first interlock tongue which mates with a corresponding first interlock groove of the structure and a second interlock tongue which mates with a corresponding second interlock groove of the clamp.

5. The mullion or transom structure of claim 4 where the first interlock tongue and second interlock tongue have identical reverse configuration, and the first interlock groove and second interlock groove have identical reverse configuration.

6. The mullion or transom structure of claim 1 where the component includes a pair of seal receiver slots and includes a stem which projects into a space between a first panel and a second panel of the curtain wall or window wall system, the stem includes a pre-set groove configured to receive a pressure plate fastener.

7. The mullion or transom structure of claim 1 further comprising a metal cap connected in part to the structure and in part to the clamp, the metal cap enclosing the fastener within the structure.

8. The mullion or transom structure of claim 1 where the metal mullion or transom structure is a mullion structure and includes a first metal segment and a separate second metal segment connected to the first segment, the first segment defining the outer side, the second segment including a groove for receiving a wing of the first segment and a groove for receiving a wing of the clamp.

9. The mullion or transom structure of claim 8 where the second segment includes a second insulating component abutting an outer side of the second segment.

10. The mullion or transom structure of claim 1 where the structure is a mullion structure and the component is a first insulating polymer component, the mullion structure further comprising a second insulating polymer component connected to the mullion structure by a second clamp, the second clamp secured to the mullion structure with a second fastener, the second fastener positioned in a spaced relationship to the second component.

11. A curtain wall or window wall system including the mullion or transom structure of claim 1, and further comprising a first panel and a second panel defining a space into which a stem of the component extends, a seal positioned between and abutting the first panel and the component.

12. The curtain wall or window wall system of claim 11 further comprising a pressure plate, a seal positioned between and abutting the first panel and the pressure plate, a pressure plate fastener passing through the pressure plate and into the stem, a spacer block positioned between the stem and the first panel.

13. A method of making a structure for a curtain wall or window wall system utilizing the mullion or transom structure of claim 1 and connecting a cap in part to the structure and in part to the clamp after inserting the fastener into the structure.

14. A vertical mullion or horizontal transom structure for use with a curtain wall or window wall system, the mullion or transom structure comprising:

a metal mullion or transom structure having an outer side;

an insulating component abutting the outer side and having a seal receiver configured to receive a seal to abut against a panel; and the component secured to the structure by a clamp, the clamp secured to the structure with a fastener, the fastener positioned in a spaced relationship to the component and where the component includes an interlock tongue which mates with a corresponding interlock groove of the structure.

15. A vertical mullion or horizontal transom structure for use with a curtain wall or window wall system, the mullion or transom structure comprising:

a metal mullion or transom structure having an outer side;

an insulating component abutting the outer side and having a seal receiver configured to receive a seal to abut against a panel; and the component secured to the structure by a clamp, the clamp secured to the structure with a fastener, the fastener positioned in a spaced relationship to the component and where the outer side is defined at least in part by an outer wall, the fastener having a longitudinal shank having a longitudinal axis oriented parallel to the outer wall.

16. A vertical mullion or horizontal transom structure for use with a curtain wall or window wall system, the mullion or transom structure comprising:

a metal mullion or transom structure having an outer side;

an insulating component abutting the outer side and having a seal receiver configured to receive a seal to abut against a panel; and the component secured to the structure by a clamp, the clamp secured to the structure with a fastener, the fastener positioned in a spaced relationship to the component and where the component includes an integral stem configured to project into a space between a first panel and a second panel of the curtain wall or window wall system, the stem projects longitudinally into the space, the fastener having a longitudinal shank having a longitudinal axis oriented perpendicular the stem.

17. A vertical mullion or horizontal transom structure for use with securing panels of a curtain wall or window wall system, the panels having parallel planer subpanels, the mullion or transom structure comprising:

a metal mullion or transom structure having an outer wall, the outer wall oriented parallel the subpanels;

an insulating component abutting the outer wall and having a seal receiver configured to receive a seal to abut against a panel; and the insulating component secured to the structure by a clamp, the clamp secured to the structure with a fastener, the fastener positioned in a spaced relationship to the component and parallel the subpanels.

18. The mullion or transom structure of claim 17 where the structure and the clamp define an outer side, the component covering an entirety of the outer side.

19. A mullion or transom structural member for use with a mullion or transom structure of a curtain wall or window wall system, the member comprising:

a metal structural segment having an outer side wall having an outward-facing planar face;

a transition wall extending from the side wall and projecting inward;

a first fastener wall connected to the transition wall and oriented parallel the outer side wall;

a second fastener wall together with the first fastener wall defining a fastener slot configured to receive a fastener, the outer side wall in part defining a groove configured to receive a tongue of an insulating component at the outward-facing planar face; and a threaded fastener positioned within the fastener slot.

20. The mullion or transom structure member of claim 19 further comprising a clamp, the threaded fastener passing through the clamp and into the fastener slot.

* * * * *